US007458668B2

(12) United States Patent
Peng et al.

(10) Patent No.: US 7,458,668 B2
(45) Date of Patent: Dec. 2, 2008

(54) INK JET CARTRIDGE

(75) Inventors: Ming-Chung Peng, Hsinchu (TW); Tien-Hung Lin, Yonghe (TW)

(73) Assignee: Benq Corporation, Taipei (TW)

( * ) Notice: Subject to any disclaimer, the term of this patent is extended or adjusted under 35 U.S.C. 154(b) by 403 days.

(21) Appl. No.: 11/298,904

(22) Filed: Dec. 9, 2005

(65) Prior Publication Data

US 2006/0125890 A1 Jun. 15, 2006

(30) Foreign Application Priority Data

Dec. 9, 2004 (TW) ..... 93138080 A

(51) Int. Cl.
*B41J 2/175* (2006.01)

(52) U.S. Cl. ..... 347/87; 347/86

(58) Field of Classification Search ..... 347/86, 347/87

See application file for complete search history.

(56) References Cited

U.S. PATENT DOCUMENTS 4,368,478 A * 1/1983 Koto ..... 347/86
5,657,058 A * 8/1997 Mochizuki et al. ..... 347/7
6,739,711 B2 * 5/2004 Lee et al. ..... 347/87
6,796,645 B2 * 9/2004 Hayashi et al. ..... 347/86
6,824,259 B2 * 11/2004 Liu ..... 347/86

FOREIGN PATENT DOCUMENTS

WO WO2004045855 6/2004

OTHER PUBLICATIONS

CN Office Action mailed May 25, 2007.

* cited by examiner

*Primary Examiner*—Anh T. N. Vo
(74) *Attorney, Agent, or Firm*—Thomas, Kayden, Horstemeyer & Risley

(57) ABSTRACT

An ink jet cartridge. The ink jet cartridge includes a housing having a chamber, an absorbing member installed in the chamber, and a cover having a first opening therethrough and a protrusion formed on the cover surface toward the absorbing member around the first opening.

18 Claims, 3 Drawing Sheets

INK JET CARTRIDGE

BACKGROUND

The present invention relates to an ink jet cartridge, and more specifically to an ink jet cartridge which may reduce ink spillage.

The ink jet printing technique has been developed for many years. It is a non-contact method of injecting ink onto an acceptor such as paper, specialized printing paper, or film. Ink jet printers are low cost and provide low-noise and full-color printing quality.

Ink jet cartridges comprise three types. The first type is installed in an ink jet head in a printer (Epson). The second is separately installed in an ink jet head, an ink jet cartridge, and a printer (Canon). The third is combining an ink jet head and an ink jet cartridge (HP and Lexmark). All of the above ink jet cartridges comprise a housing using as an ink storage tank and a cover. Ink stored in an ink storage tank enters an ink jet head to process ink jet printing.

A cover is an essential element of an ink jet cartridge. It is used to prevent ink spillage or multi-color ink mixing.

To facilitate air entering an ink jet cartridge, several openings must be provided on the cover thereof. Therefore, when an ink jet cartridge is shaken or placed upside down, ink easily spills from the openings, contaminating the ink jet cartridge.

Additionally, in the related art, an absorbing member is compressed by a rib of a cover. The rib, however, is easily broken when supersonic welding is performed, significantly reducing the compressing force.

SUMMARY

In order to solve problems related to the conventional technology, the invention provides an ink jet cartridge having a new type of cover capable of eliminating ink spillage and effectively fixing an absorbing member.

The invention provides an ink jet cartridge includes a housing having a chamber, an absorbing member installed in the chamber, and a cover having a first opening therethrough and a protrusion formed on the cover surface toward the absorbing member around the first opening.

The cover is formed by injection molding. The cover further comprises a first and a second fillisters formed on another surface thereof. The two fillisters are linked. The first fillister is linked with the first opening and the second fillister is linked with a second opening.

The protrusion comprises two bumps and additional walls, wherein the two bumps correspond to the first and second fillisters respectively.

The invention further provides a sealing material to seal the first fillister, the second fillister, the first opening, and the second opening, wherein the second opening is partially exposed. Additionally, the housing is further assembled with a nozzle driving chip.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION

Figure 1:
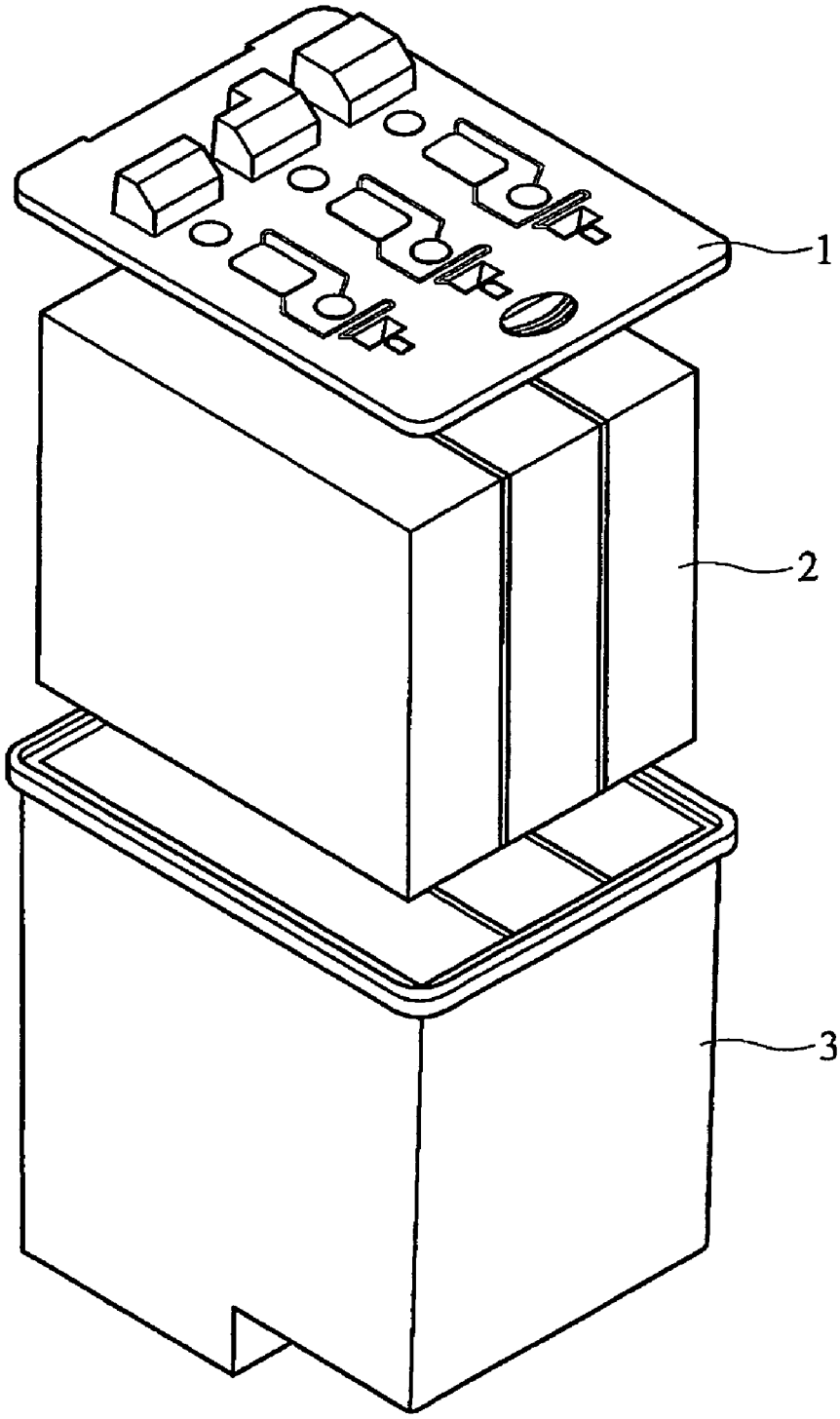
FIG. 1 shows an ink jet cartridge structure of the invention.

The features of an ink jet cartridge structure of the invention are illustrated in FIGS. 1~4. Referring to FIG. 1, the ink jet cartridge comprises a housing 3, an absorbing member 2 comprising absorbent polymer installed in the housing 3, and a cover 1, wherein the housing 3 is an ink storage tank.

Figure 2:
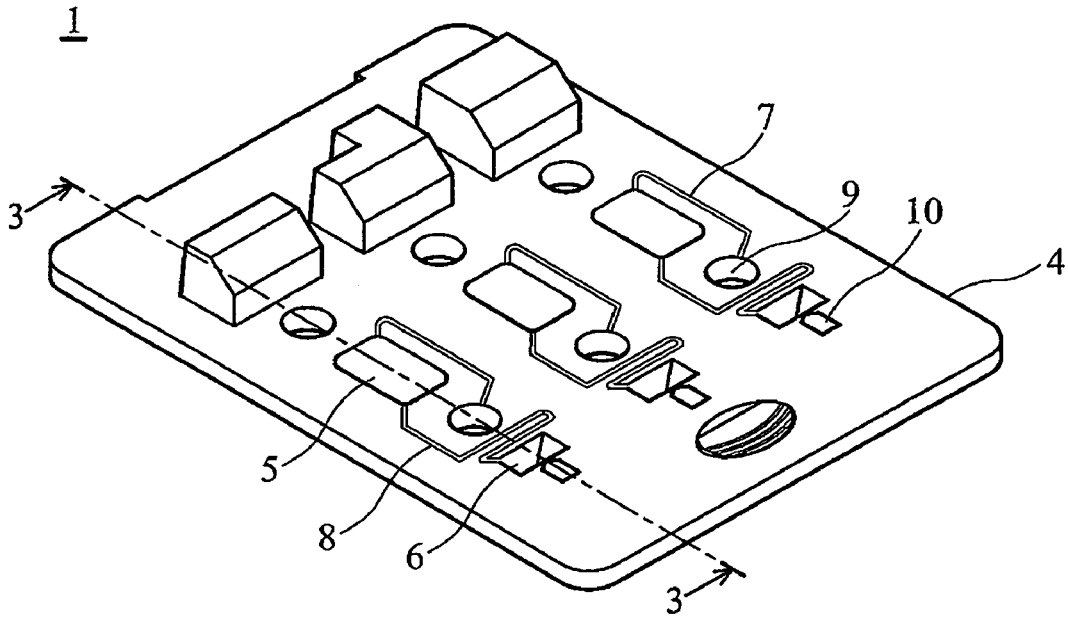
FIG. 2 shows an upper surface of a cover of an ink jet cartridge of the invention.
Figure 3:
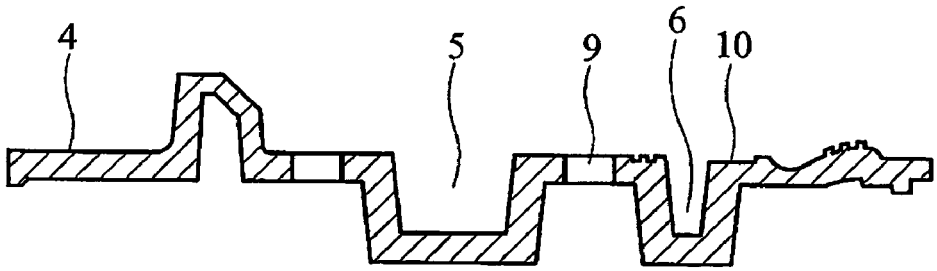
FIG. 3 is a cross section of a cover structure of an ink jet cartridge of the invention.
Figure 4:
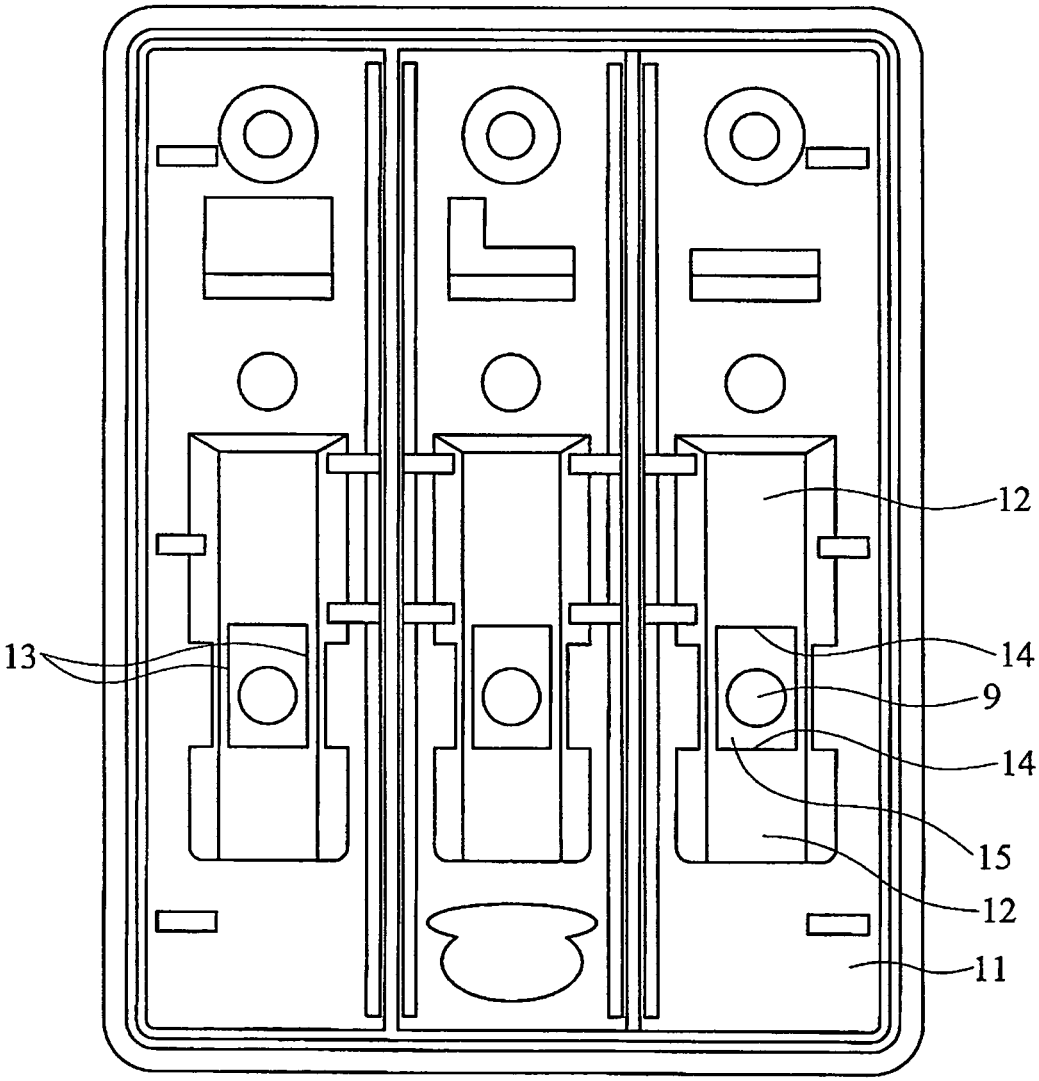
FIG. 4 shows a lower surface of a cover of an ink jet cartridge of the invention.

The cover is formed by injection molding and has a uniform thickness. The design of the upper and lower surfaces of the cover 1 is illustrated in FIG. 2~4. Referring to FIG. 2, the upper surface 4 of the cover 1 comprises a first fillister 5, a second fillister 6, a first channel 7, a second channel 8, a first opening 9, and a second opening 10, wherein the second fillister 6 is linked with the second opening 10, the first fillister 5 is linked with the first opening 9 by the first channel 7, and the first fillister 5 is linked with the second fillister 6 by the second channel 8.

The design of the lower surface of the cover is illustrated in FIGS. 3~4. FIG. 3 is a cross section along the tangent line 3-3 of FIG. 2. Referring to FIG. 4, a protrusion comprising two bumps 12 and additional walls 13 is formed on the lower surface 11 of the cover 1, wherein an including space 15 around the first opening 9 is formed by the additional walls 13 and the inner walls 14 of the bumps 12.

The corresponding relationship between the upper and lower surfaces of the cover 1 is illustrated in FIG. 3. The first fillister 5 and the second fillister 6 of the upper surface 4 correspond to the two bumps 12 of the lower surface 11 respectively, that is, the first and second fillisters are extended toward the lower surface 11 to form the two bumps 12. The width of the bump 12 is about 2~8 cm. The bumps 12 and the additional walls 13 have the same height.

The ink jet cartridge further comprises a sealing material (not shown) stuck on the upper surface 4 of the cover 1 to seal the first fillister 5, the second fillister 6, the first opening 9, and the second opening 10, wherein the second opening 10 is partially exposed. The sealing material comprises PET, PE, PP, PS, or PVC, preferably PET.

The absorbing member 2 installed in the housing 3 is compressed by the bumps 12 and additional walls 13 formed on the lower surface 11 of the cover 1. Compared to the related art, which uses a rib to compress an absorbing member, the invention provides a larger compression area to more effectively avoid ink spillage and substantially increase the compression ratio of the absorbing member.

Even if the ink jet cartridge is strongly shaken, resulting in ink spillage, the spilled ink may then be stored in the first fillister 5 through the first channel 7 (as shown in FIG. 2) without contaminating the cover 1.

Additionally, air may enter the ink jet cartridge by the path (the second opening 10→the second fillister 6→the second channel 8→the first fillister 5→the first channel 7→the first opening 9) to drive ink out of nozzles.

Due to the including space 15 formed on the lower surface 11 of the cover 1, air can enter the ink jet cartridge through the first opening 9, but ink will not be spilled from the first opening 9. The housing 3 is further assembled with a nozzle driving chip to drive nozzles.

While the invention has been described by way of example and in terms of preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An ink jet cartridge, comprising:

a housing having a chamber;

an absorbing member installed in the chamber;

a cover having a first opening therethrough and a protrusion formed on the cover surface toward a absorbing member around the first opening; and a first fillister and a second fillister surrounded by the protrusion.

2. The ink jet cartridge as claimed in claim 1, wherein the absorbing member is an absorbent polymer.

3. The ink jet cartridge as claimed in claim 1, wherein the cover is formed by injection molding.

4. The ink jet cartridge as claimed in claim 1, wherein the protrusion comprises two bumps and additional walls.

5. The ink jet cartridge as claimed in claim 4, wherein the bump has a width of about 2-8 cm.

6. The ink jet cartridge as claimed in claim 4, wherein the two bumps and additional walls have the same height.

7. The ink jet cartridge as claimed in claim 4, further comprising, the first and the second fillisters formed on another cover surface, wherein the first and second fillisters are linked and correspond to the two bumps respectively, and the first fillister is linked with the first opening and the second fillister is linked with a second opening.

8. The ink jet cartridge as claimed in claim 7, wherein the first fillister stores ink spilled from the first opening.

9. The ink jet cartridge as claimed in claim 1, further comprising, a nozzle driving chip assembled with the housing.

10. An ink jet cartridge, comprising:

a housing having a chamber;

an absorbing member installed in the chamber to absorb ink;

a cover having a first opening therethrough;

a protrusion formed on the cover surface toward the absorbing member to avoid spilling ink from a first opening; and a first fillister and a second fillister surrounded by the protrusion.

11. The ink jet cartridge as claimed in claim 10, wherein the absorbing member is an absorbent polymer.

12. The ink jet cartridge as claimed in claim 10, wherein the cover is formed by injection molding.

13. The ink jet cartridge as claimed in claim 10, wherein the protrusion comprises two bumps and additional walls.

14. The ink jet cartridge as claimed in claim 13, wherein the bump has a width of about 2-8 cm.

15. The ink jet cartridge as claimed in claim 13, wherein the two bumps and additional walls have the same height.

16. The ink jet cartridge as claimed in claim 13, further comprising, the first and the second fillisters formed on another cover surface, wherein the first and second fillisters are linked and correspond to the two bumps respectively, and the first fillister is linked with the first opening and the second fillister is linked with a second opening.

17. The ink jet cartridge as claimed in claim 16, wherein the first fillister stores ink spilled from the first opening.

18. The ink jet cartridge as claimed in claim 10, further comprising, a nozzle driving chip assembled with the housing.

* * * * *